US005774839A

United States Patent [19]

Shlomot

[11] Patent Number: 5,774,839

[45] Date of Patent: Jun. 30, 1998

[54] DELAYED DECISION SWITCHED PREDICTION MULTI-STAGE LSF VECTOR QUANTIZATION

[75] Inventor: Eyal Shlomot, Irvine, Calif.

[73] Assignee: Rockwell International Corporation, Newport Beach, Calif.

[21] Appl. No.: 536,890

[22] Filed: Sep. 29, 1995

[51] Int. Cl.[6] ..... G10L 9/14

[52] U.S. Cl. ..... 704/222; 704/219

[58] Field of Search ..... 395/2.31, 2.28; 704/219, 222

[56] References Cited

PUBLICATIONS

Allen Gersho and Robert M. Gray, Vector Quantization and Signal Compression, pp. 451–459, 487–506, 1992.

Houman Zarrinkoub and Paul Mermelstein, "Switched Prediction and Quantization of LSP Frequencies", Proceedings of IEEE ICASSP 96, pp. 757–760, May 1996.

Mei Yong, Grant Davidson, and Allen Gersho, "Encoding of LPC Spectral Parameters Using Switched–Adaptive Interframe Vector Prediction", Proceedings of IEEE ICASSP 88, pp. 402–405, Apr. 1988.

Kazunori Ozawa and Toshiki Miyano, "4kb/s Improved CELP Coder with Efficient Vector Quantization", Proceedings of IEEE ICASSP 91, pp. 213–216, Apr. 1991.

*Primary Examiner*—David R. Hudspeth
*Assistant Examiner*—Tālivaldis Ivars Šmits
*Attorney, Agent, or Firm*—William C. Cray; Philip K. Yu

[57] ABSTRACT

An apparatus and method of quantizing a sequence of input data vectors using delayed decision switched prediction and vector quantization. The method has the following steps of operation: (a) predicting a next vector element from said sequence of input data vectors to generate a set of prediction vectors; (b) subtracting the set of prediction vectors from the next vector element to generate a set of prediction error vectors; (c) multi-stage vector quantizing the set of prediction error vectors to generate a set of quantized prediction error vectors with each of the stages having at least one of the tables and local decision means to generate a final quantization error vector according to a predetermined distance measure; (d) selecting one predictor out of the set of predictors from the switched prediction step and selecting, for each of the stages, at least one entry from the set of tables of the vector quantization step according to the predetermined distance measure, generating a quantized data vector.

10 Claims, 6 Drawing Sheets

DELAYED DECISION SWITCHED PREDICTION MULTI-STAGE LSF VECTOR QUANTIZATION

FIELD OF INVENTION

The present invention relates to speech coding in communication systems and more particularly to spectral quantization in speech coding.

ART BACKGROUND

Modern communication systems rely heavily on digital speech processing in general and digital speech compression in particular. Examples of such communication systems are digital telephony trunks, voice mail, voice annotation, answering machines, voice over data links, etc.

High compression ratio is typically required for low-rate transmission or speech storage and may be achieved by parametric modeling of the speech signal. The speech encoder analyzes the speech signal to obtain a set of representative parameters, which are then quantized and sent, or stored, by a digital medium. As needed, the speech decoder combines the speech parameters to produce the synthesized speech. Examples of such coders are Code Excited Linear Prediction (CELP) and the newly emerging methods of harmonic coding.

Almost all low-rate speech coding algorithms analyze the speech spectral envelope and use it as an important component of the speech parametric representation. Almost all low-rate speech coders use the set of 8 to 12 Linear Prediction Coding (LPC) parameters to model the speech spectral envelope (also called "short term linear prediction"). The portion of the speech which cannot be predicted by the short term linear prediction is commonly called "residual". The spectral envelope parameters and the residual parameters are quantized and then sent or stored. The decoder uses the quantized parameters to reconstruct an approximation of the residual signal (commonly called "excitation") and an approximation of the spectral envelope (commonly called "LPC filter"). FIG. 1 shows a typical LPC-based speech decoder. The excitation signal (4) is generated by an excitation generator (2), and is fed into the LPC filter (6), which produces the synthesized speech (8). The spectral envelope changes with time, and is updated on regular intervals. The interval's duration is usually 10 to 30 milliseconds. At the sampling rate of 8K Hz, each interval consists of 80 to 240 samples, commonly referred to as "LPC frame".

There are several ways to represent the set of LPC parameters. In modern speech coding almost all coders use the set on Line Spectral Frequencies (LSF) as a representing set. There are direct conversion algorithms from the set of LPC parameters to the set of LSF parameters and vise-versa.

The set of LSF parameters can be quantized in many ways. Each parameter can be quantized separately, and this method is called scalar quantization. If more than one or all of the parameters are quantized together, this is called Vector Quantization (VQ). The name "Vector Quantization" comes from the organization of the set of parameters as a vector. VQ gives better quantization results than scalar quantization but is more complex. For example, if 24 bits are used to quantize the vector of LSF at once, a code book of the size 2**24=16,777,216 is needed. The storage and the search complexity of such a large code book make it impractical for commercial use. However, sub-optimal vector quantizers are commonly used for LSF quantization.

The sub-optimal vector quantizers can be classified into split vector quantizers and multi-stage vector quantizers.

In split VQ, the vector of LSF is divided into few (usually 3 or 4) subvectors, and each sub-vector (which is by itself a vector of lower dimension) is vector quantized separately. For example, if the LSF vector is of 10 dimensions, it can be divided into 3 sub-vectors of 3, 3 and 4 dimensions each and 8 bit code book (size 2**8=256) can be used for each sub-vector. This scheme can be easily implemented on modern Digital Signal Processor (DSP).

In multi-stage VQ, a sequence of code books is used, where each stage quantizes the quantization error of the previous one. A schematic diagram of the operation of a 4-stage vector quantizer is depicted in FIG. 2A. The first code book quantizes the original vector (300). The quantization error of the first code book (310) is the difference between the original vector and the chosen entry (305) of the first code book. This difference is then quantized by the second code book and its quantization error (320) is quantized by the third code book and so on. The represented vector is the sum of the 4 chosen entries (vectors) from the 4 code books. For better quantization results, a number of error candidates vectors are kept from stage to stage, and the final decision for the entries of all the code books is done only when the final stage is searched. This method is called Delayed Decision (DD). The number of candidates from stage to stage can vary and dictates the search complexity on one hand and the quantization performance on the other hand. If more candidates are kept the search complexity increases but the quantization results are better and visa-versa.

It was found that multi-stage VQ performs poorly with only one candidate, but only a few candidates (4–6) are needed for near optimal performance. A multi-stage multi-candidate VQ structure is depicted in FIG. 2B. The following operation is described for the case of only one input vector. The input vector (10) is first quantized by the code book of the first stage (15). The candidates error vectors of the first stage (20) are then quantized by the second stage (25). Each stage quantizes the candidates error vectors of the previous stage, until the last stage (40) is reached. Only then the entries decision is made for all the stages, by backward searching from the last stage (40) to the first stage (15) of the path of candidates which ended in the best quantization result in the last stage (40).

Vector quantization exploits the intra-vector structure of the LSF vector for good quantization. The inter-vector correlation of successive LSF vectors can be utilized by predictive coding. In predictive coding the current frame vector is predicted from one or few past vectors. The prediction error, which is the difference between the current frame LSF vector and its prediction, can be quantized by any of the practical quantization schemes described above (e.g., split-VQ or multi-stage VQ).

Switched Prediction (SP) schemes have been suggested for high prediction performance. In SP, a bank of predictors is used. For each input vector, all the predictors are tested, and the predictor with the highest performance is used. Since the speech decoder must know which predictor was chosen by the encoder, the index of the chosen predictor must be sent. The bits used for the predictor information are taken from the VQ bits.

FIGS. 3A and 3B describe an auto-regressive ("AR") predictive coding scheme in general and switched predictive coding scheme in particular. However, those skilled in the art can easily determine prediction schemes based on moving average ("MA"), or on combined AR and MA ("ARMA") scheme. The prediction of the input vector (52)

is subtracted from the input vector (50). The prediction error vector (53) is quantized by the VQ (55). The quantized prediction error vector (56) is added to the prediction of the input vector (52), to form the quantized input vector (57). The quantized input vector is delayed by the set of delay units (60). The next frame predicted input vector (52) is generated by the set of predictors (65), each operating on the properly delayed quantized input vector (57). In linear prediction, each of the prediction units is a matrix. In switched prediction, different sets of matrices are tested in (65), and the best one chosen by the decision unit (70), according to some criterion, is used.

The main drawback of the switched prediction method, as proposed in the literature, is the de-coupling of the prediction decision from the quantization decision. The predictor is chosen by the minimal weighted energy of the prediction error vector (53). However, this error vector might not yield the minimal weighted energy of the quantized prediction error vector (56). A reasonable solution would be to use multiple prediction candidates and delayed decision scheme, i.e., coupling the switched prediction (65) with the VQ (55) and make the decision according the minimal weighted energy of the quantized 11 prediction error (56). Noticeably, if a full VQ or split VQ are used in module (55), the search complexity is increased proportionally to the product of the number of prediction candidates by the code book size. However, if a multi-stage VQ is used in (55), the complexity increase is only proportional to the product of the number of prediction candidates by the first stage size.

SUMMARY OF THE INVENTION

An apparatus and method of quantizing a sequence of input data vectors using switched prediction and vector quantization. The method has the following steps of operation: (a) predicting a next vector element from said sequence of input data vectors to generate a set of prediction vectors; (b) subtracting the set of prediction vectors from the next vector element to generate a set of prediction error vectors; (c) multi-stage vector quantizing the set of prediction error vectors to generate a set of quantized prediction error vectors with each of the stages having at least one of the tables and local decision means to generate a final quantization error vector according to a predetermined distance measure; (d) selecting one predictor out of the set of predictors from the switched prediction step and selecting, for each of the stages, at least one entry from the set of tables of the vector quantization step according to the predetermined distance measure, generating a quantized data vector.

DETAILED DESCRIPTION OF THE PREFERRED EMBODIMENT

Figure 1:
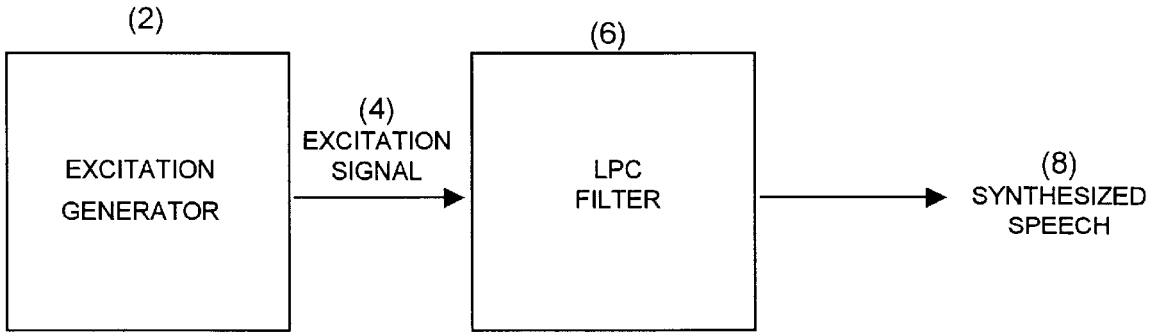
FIGURE 1 (Prior Art)
FIG. 1 is block diagram of a typical LPC based speech decoder.
Figure 2A:
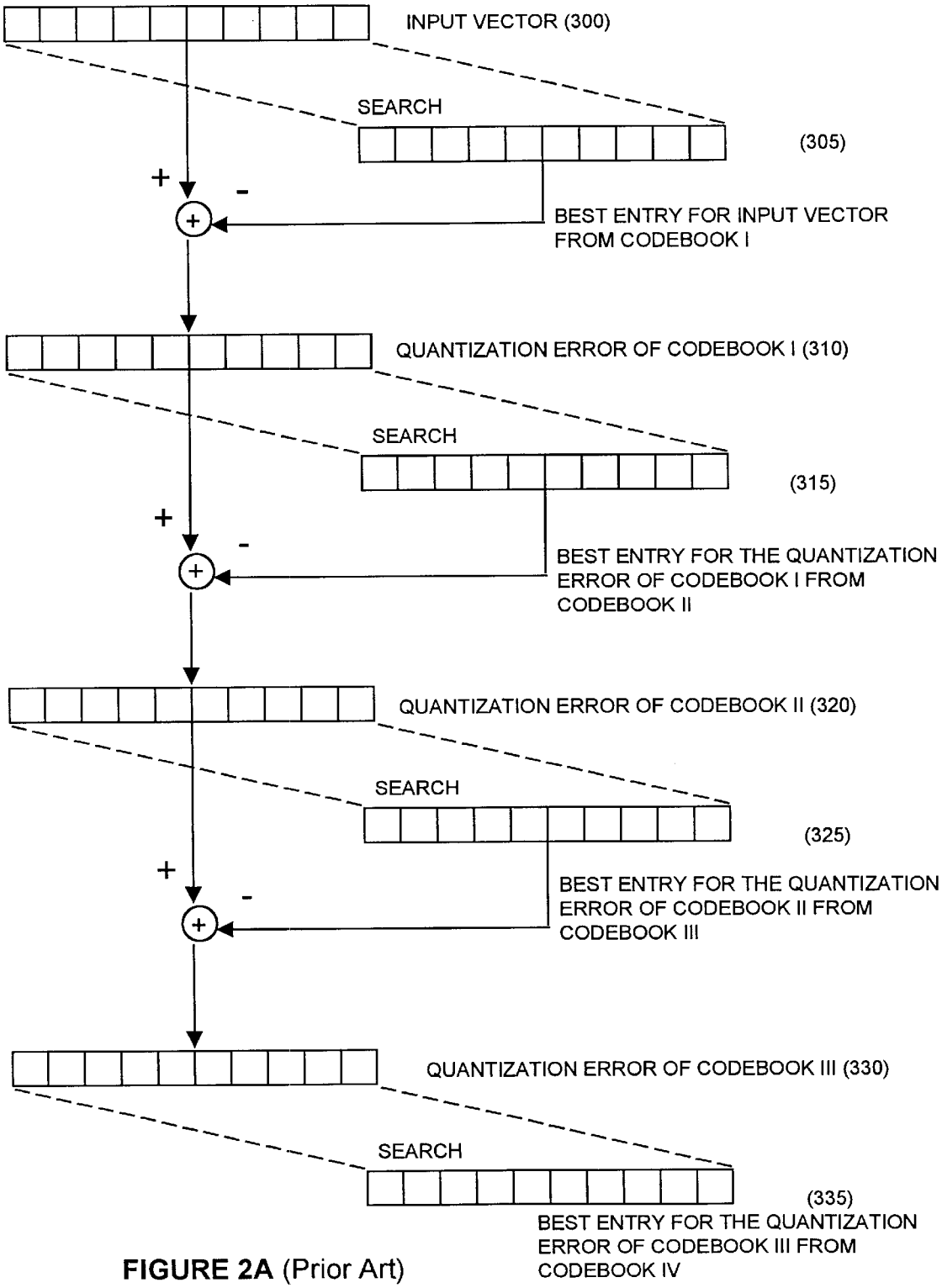
FIGURE 2A (Prior Art)
FIG. 2A is schematic diagram of the operation of a 4-stage vector quantizer.
Figure 2B:
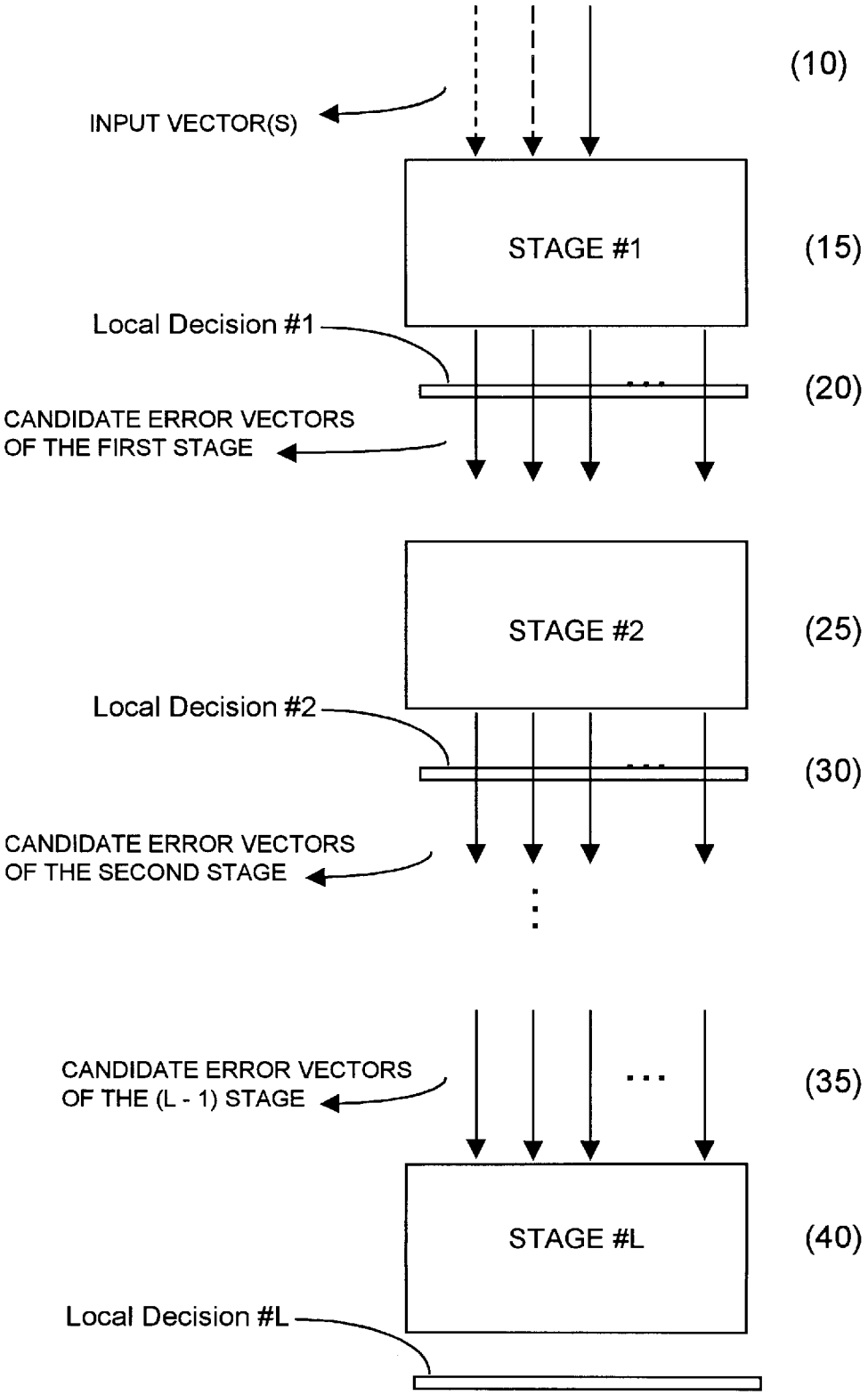
FIGURE 2B (Prior Art)
FIG. 2B is block diagram of a multi-stage vector quantizer.
Figure 3A:
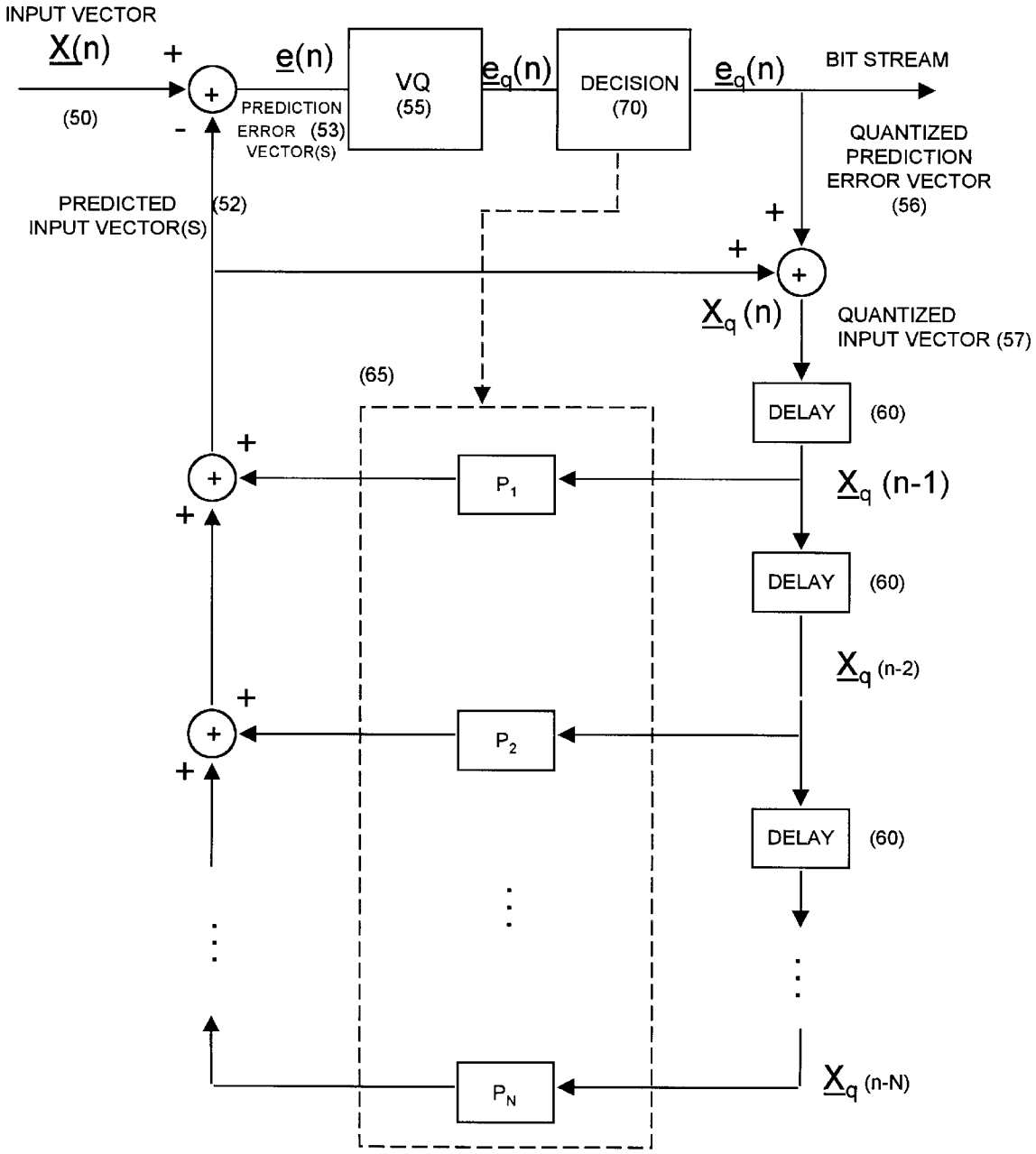
FIG. 3A is a detailed diagram of an auto-regressive switched prediction coding scheme.
Figure 3B:
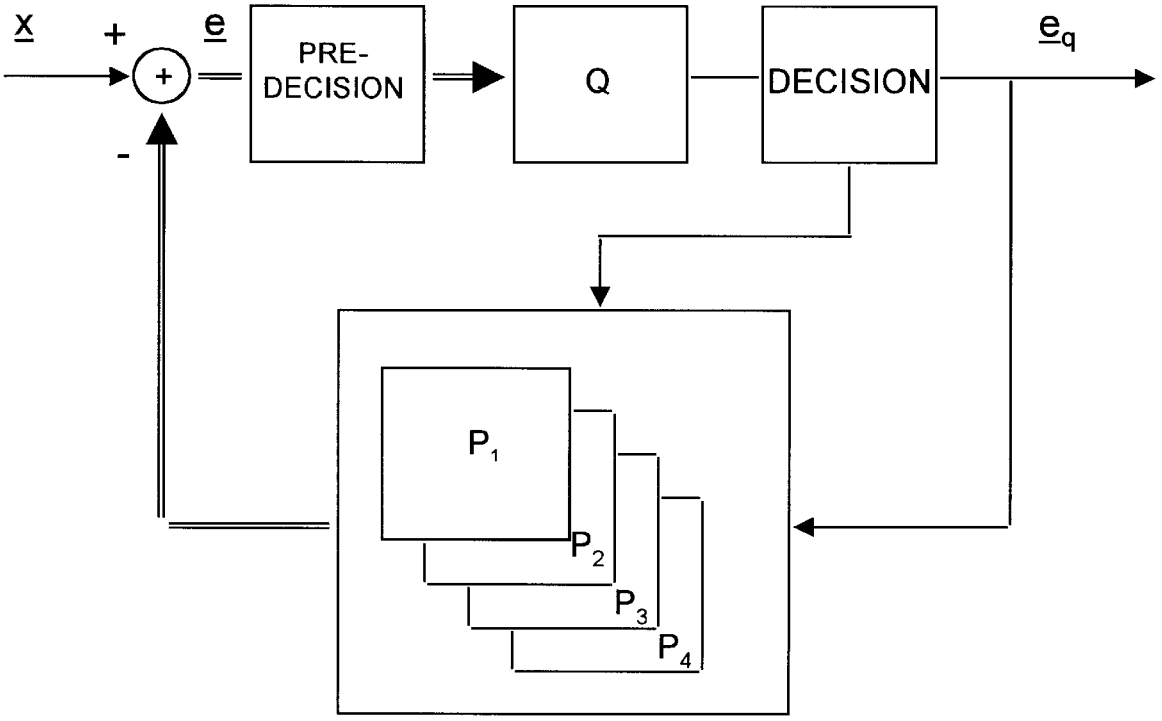
FIG. 3B is a block diagram of switched prediction coding scheme.

In the preferred embodiment, the multi-stage VQ depicted in FIG. 2B is used as the VQ module (55) of FIG. 3A, and is coupled with the switched predictor (65). In this coupled configuration, the decision of the best prediction is obtained together with the decision of code books entries in the multi-stage VQ.

Figure 4:
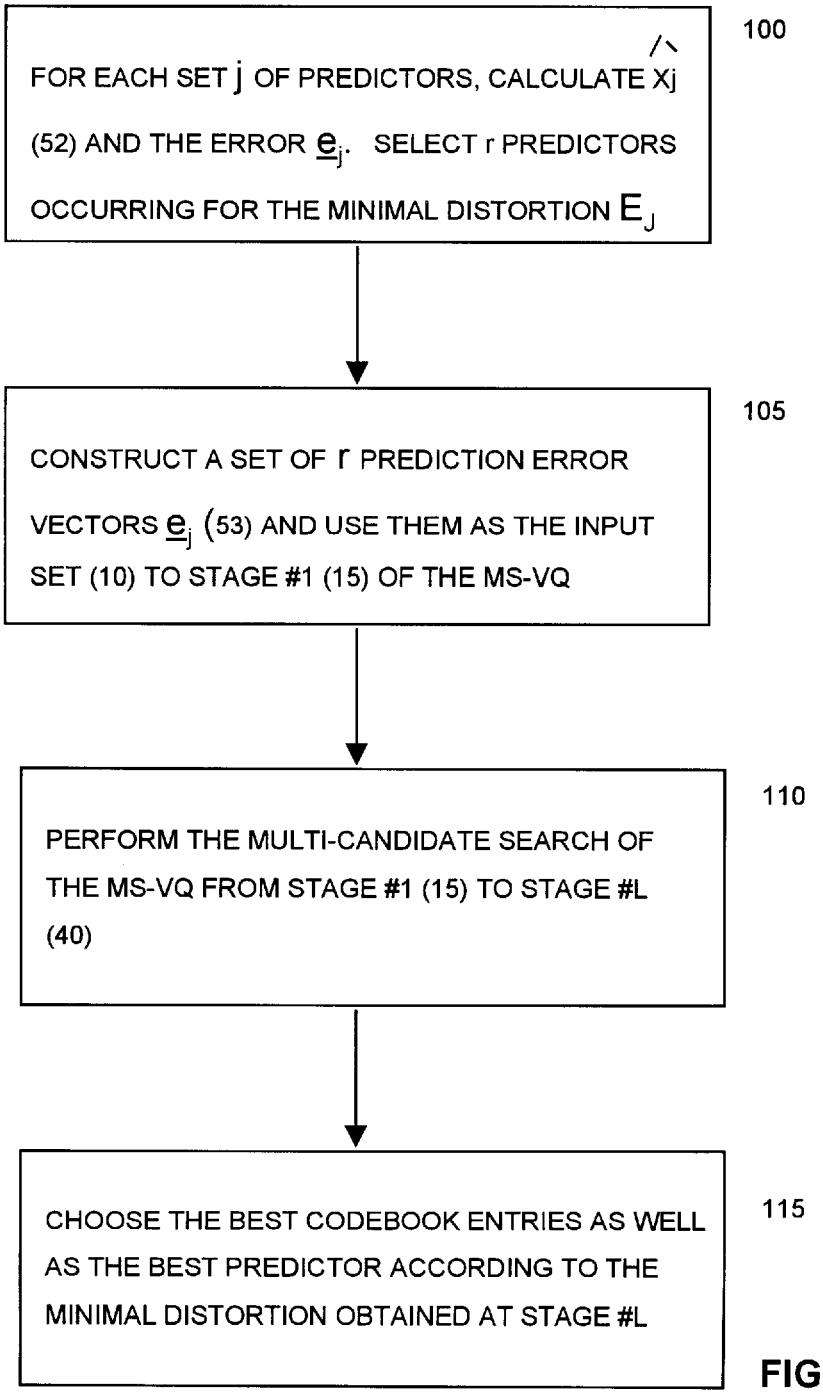
FIG. 4 is flow chart of the operation of a delayed decision switched prediction multi-stage vector quantization scheme.

The flow chart in FIG. 4 describes the operation of the delayed-decision switched prediction multi-stage VQ in accordance with the present invention. The switched prediction uses a pre-designed set of predictors (matrices):

$$\{P_1^j, p_2^j, \ldots, P_N^j\}_{j=1}^R.$$

The multi-stage VQ uses pre-designed L stages code books given by:

$$\{c_1^1, c_2^1, \ldots, c_{m_1}^1, \},$$

$$\{c_1^2, c_2^2, \ldots, c_{m_2}^2\},$$

$$\{c_1^L, c_2^L, \ldots, c_{M_L}^L\}.$$

At the first step (100), each set of predictors is tested in module (65). The linear prediction operation is given by the equation:

$$\hat{\underline{x}}_j(n) = \sum_{i=1}^{N} P_i^j \underline{x}_q(n-i) \text{ for } j = 1, \ldots, R.$$

The set of prediction error vectors (53) is constructed by:

$$\underline{e}_j(n)=\underline{x}(n)-\underline{x}_j(n) \text{ for j=1, . . . R.}$$

The weighted energies of the prediction error vectors (53) are given by:

$\epsilon j=\underline{e}_j^T W \underline{e}_j$, where W is a diagonal weights matrix. (The time index n was omitted for convenience.) A sub-set of the r of predictors is chosen according to the minimal weighted energy of the prediction error vectors (53).

In the next step (105), the set of rcandidates prediction error vectors (53) is constructed, using the set of chosen predictors from step (100), and is used as the candidate set (10) for stage #1 (15).

In step (110), the multi-candidate search of the multi-stage VQ is performed from the first stage (15) to the last stage (40), where in this case the first stage (15) has rcandidates input vectors (10). At each stage k, the weighted error measure:

$$d_l^k=(\underline{e}-\underline{c}_j^k)^T W(\underline{e}-\underline{c}_j^k)$$

is calculated for j=1, . . . , $M_k$ and for each candidate in the set of previous stage's error vector. The candidate set for the next stage is generated, according to the minimum weighted error measure, by the difference of a candidate from the previous stage and a chosen codebook entry.

At the final step (115), the code book entries and the predictor are chosen by the decision unit (70), using a backward search from the last stage (40) to the first stage (15) of the path of candidates which ended in the best quantization result in the last stage (40). This path now includes the candidates input vectors (10) to the first stage (15). The best candidate for the first stage (15) indicates the best predictor to be used in (65).

Note that if the multi-stage VQ of FIG. 2B is used as the VQ module (55) in FIG. 3A, the input vectors (10) are the prediction error vectors (53), and that the sum of all the chosen entries from all the code book entries constitutes the quantized prediction error vector (56).

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. In a communication system for communicating input signals using a digital medium. the communication system comprising an encoder which receives and processes the input signals to generate a quantized data vector for either transmission or storage by the digital medium, the encoder comprising an analyzer for analyzing the input signals to generate a set of representative parameters associated with the input signals, and a quantizer for quantizing a sequence of data vectors from among the set of representative Daramеters corresponding to the input signals to generate the quantized data vector, the quantizer comprising:

switched prediction means comprising a set of predictors for predicting a next vector element from said sequence of input data vectors to generate a set of prediction vectors;

difference means coupled to said switched prediction means for subtracting said set of prediction vectors from said next vector element to generate a set of prediction error vectors;

vector quantization means comprising a predetermined set of tables for quantizing said set of prediction error vectors to generate a set of quantized prediction error vectors, said vector quantization means comprising a plurality of stages, each of said plurality of stages comprising at least one of said set of tables and local decision means, wherein:

a first stage quantizes said set of prediction error vectors from said difference means to generate a first set of candidates of quantization error vectors, by selecting, for each candidate in said first set of candidates, a prediction error vector and at least one entry from at least one of said set of tables according to a predetermined distance measure;

a final stage, coupled to said first stage, quantizes said first set of candidates of quantization error vectors from first stage, to generate a final quantization error vector by selecting a member of said first set of candidates of quantization error vectors from said first stage and at least one entry from at least one of said set of tables, according to said predetermined distance measure;

global decision means for selecting one predictor out of said set of predictors from said switched prediction means and selecting, for each of said first and final stages, at least one entry from said set of tables of said vector quantization means according to said predetermined distance measure, generating said quantized data vector.

2. An apparatus according to claim 1, further comprising:

at least one intermediate stage, coupled between said first stage and said final stage, for quantizing said first set of candidates of quantization error vectors from said first stage to generate a set of candidates of quantization error vectors to be received by said final stage to generate said final quantization error vector, wherein said global decision means further selects, for each of said intermediate stage, at least one entry from its said set of tables.

3. In a communication system for communicating input signals using a digital medium the communication system comprising an encoder which receives and processes the input signals to generate a quantized data vector for either transmission or storage bv the digital medium the encoder comprising an analvzer for analyzing the input signals to generate a set of representative parameters associated with the input signals, and a quantizer for quantizing a sequence of data vectors from among the set of representative parameters corresponding to the input signals to generate the quantized data vector, the quantizer comprising:

switched prediction means comprising a set of predictors for predicting a next vector element from said sequence of input data vectors to generate a set of prediction vectors;

difference means coupled to said switched prediction means for subtracting said set of prediction vectors from said next vector element to generate a set of prediction error vectors;

vector quantization means, comprising a predetermined set of tables, for quantizing said set of prediction error vectors to generate a set of quantized prediction error vectors, said vector quantization means comprising a plurality of stages, numbered from 1 to L, each of said stages comprising at least one of said set of tables and local decision means, wherein:

stage 1 quantizes said set of prediction error vectors from said difference means, to generate a first set of candidates of quantization error vectors by selecting, for each candidate in said set of candidates, a prediction error vector and at least one entry from its tables according to a predetermined distance measure;

n-th stage, wherein $2 \leqq n \leqq (L-1)$ quantizes a set of candidates of quantization error vectors from (n−1)-stage to generate a new set of candidates of quantization error vectors by selecting, for each candidate in its corresponding set of candidates, a member of the set of quantization error vectors from said (n−1) -th stage and at least one entry from its tables according to said predetermined distance measure;

stage "L" quantizes a set of candidates of quantization error vectors from (L−1) stage to generate one quantization error vector by selecting a member of the set of quantization error vectors from said (L−1) stage and at least one entry from its tables according to said predetermined distance measure;

global decision means for selecting one predictor out of said set of predictors from said switched prediction means and selecting, for each stage, at least one entry from said set of tables of said vector quantization means according to said predetermined distance measure, generating said quantized data vector.

4. An apparatus according to claim 3, wherein:

said switched prediction means comprises of a delay tap line and a set of linear predictors in the form of matrix multiplication.

5. An apparatus according to claim 4, wherein:

said delay tap line comprises either one of a 1-vector delay unit or a 2-vector delay unit for said quantized data vector.

6. An apparatus according to claim 3, further comprising:

a pre-decision means for selecting a subset of predictors from said set of predictors based on a second predetermined distance measure prior to said vector quantization means.

7. An apparatus according to claim 6, wherein:

said switched prediction means comprises of a delay tap line and a set of linear predictors in the form of matrix multiplication.

8. An apparatus according to claim 7, wherein:

said delay tap line comprises either one of 1-vector delay unit or 2-vector delay unit for said quantized data vector.

9. In a communication svstem for communicating input signals using a digital medium, the communication svstem comprising an encoder which receives and processes the input signals to generate a quantized data vector for either transmission or storage by the digital medium, the encoder comprising an analvzer for analyzing the input signals to generate a set of representative parameters associated with the input signals, and a guantizer for quantizing a sequence of data vectors from among the set of representative parameters corresponding to the input signals to generate the quantized data vector, the quantizer comprising:

predicting a next vector element from said sequence of input data vectors using switched prediction means comprising a set of predictors to generate a set of prediction vectors;

subtracting said set of prediction vectors from said next vector element using difference means coupled to said switched prediction means to generate a set of prediction error vectors;

quantizing said set of prediction error vectors using vector quantization means comprising a predetermined set of tables to generate a set of quantized prediction error vectors, said vector quantization means comprising a plurality of stages, each of said plurality of stages comprising at least one of said set of tables and local decision means, wherein:

a first stage quantizes said set of prediction error vectors from said difference means to generate a first set of candidates of quantization error vectors, by selecting, for each candidate in said first set of candidates, a prediction error vector and at least one entry from at least one of said set of tables according to a predetermined distance measure;

a final stage, coupled to said first stage, quantizes said first set of candidates of quantization error vectors from said first stage, to generate a final quantization error vector by selecting a member of said first set of candidates of quantization error vectors from said first stage and at least one entry from at least one of said set of tables, according to said predetermined distance measure;

selecting one predictor out of said set of predictors from said switched prediction means and selecting, for each of said first and final stages, at least one entry from said set of tables of said vector quantization means using global decision means according to said predetermined distance measure, generating said quantized data vector.

10. A method according to claim 9, wherein said step of quantizing using vector quantization means further comprises:

at least one intermediate stage, coupled between said first stage and said final stage, for quantizing said first set of candidates of quantization error vectors from said first stage to generate a set of candidates of quantization error vectors to be received by said final stage to generate said final quantization error vector, wherein said global decision means further selects, for each of said intermediate stage, at least one entry from its said set of tables.

* * * * *